US011859385B1

(12) United States Patent
Zhou et al.

(10) Patent No.: US 11,859,385 B1
(45) Date of Patent: Jan. 2, 2024

(54) BUILDING FRAME STRUCTURE WITH BOTH SUPPORT AND VENTILATION FUNCTIONS

(71) Applicant: A&C Future Inc, Newport Beach, CA (US)

(72) Inventors: Zhuangboyu Zhou, Santa Ana, CA (US); Jiuqi Wang, Tustin, CA (US); Sichen Li, Irvine, CA (US); Jiayang Qin, Newport Beach, CA (US); Han Qin, Newport Beach, CA (US)

(73) Assignee: A&C Future

( * ) Notice: Subject to any disclaimer, the term of this patent is extended or adjusted under 35 U.S.C. 154(b) by 0 days.

(21) Appl. No.: 17/953,022

(22) Filed: Sep. 26, 2022

(51) Int. Cl.
*E04C 3/06* (2006.01)
*E04C 3/32* (2006.01)
*E04C 3/04* (2006.01)

(52) U.S. Cl.
CPC ..... *E04C 3/06* (2013.01); *E04C 3/32* (2013.01); *E04C 2003/043* (2013.01); *E04C 2003/0465* (2013.01)

(58) Field of Classification Search
CPC ..... E04C 3/06; E04C 3/32; E04C 2003/043; E04C 2003/0465; E04F 13/007; E04F 13/072; F24F 7/06
See application file for complete search history.

(56) References Cited

U.S. PATENT DOCUMENTS

| | | | | |
|---|---|---|---|---|
| 6,955,023 | B2 * | 10/2005 | Rotheroe | E04C 3/40 52/855 |
| 7,552,569 | B2 * | 6/2009 | Rotherroe | E04C 3/40 52/843 |
| 9,969,455 | B2 * | 5/2018 | Kwag | B62J 43/28 |
| 10,472,847 | B2 * | 11/2019 | Wiles | E04C 3/06 |
| 10,605,471 | B2 * | 3/2020 | Lee | A62C 35/68 |
| 10,711,459 | B2 * | 7/2020 | Mizuno | E04B 2/825 |
| 10,914,077 | B2 * | 2/2021 | Roy | E04D 12/004 |
| 11,415,328 | B2 * | 8/2022 | Goldstein | E04F 13/072 |
| 11,598,540 | B2 * | 3/2023 | Fithian | E04F 13/072 |
| 11,767,990 | B2 * | 9/2023 | Goldstein | E04F 13/072 52/173.1 |
| 2002/0152715 | A1 * | 10/2002 | Rotheroe | E04C 3/32 52/855 |
| 2004/0250503 | A1 * | 12/2004 | Bigelow | H02G 3/0412 52/838 |

(Continued)

*Primary Examiner* — Rodney Mintz
(74) *Attorney, Agent, or Firm* — Elizabeth Yang

(57) ABSTRACT

The present invention provides a building frame structure with both support and ventilation functions, the building frame structure contains at least one starting column and multiple main beams, the main beams are connected with the starting column, and top of the starting column is connected to a fan. The starting column is a hollow cylinder, and there are four thin hollow columns in the starting column. The main beams are hollow structures, and a reinforcing wall is arranged inside the main beams, the reinforcing wall is connected with inner walls of the main beam to form multiple ventilation ducts. When the frame structure is installed, air sent by the fan flows to the ventilation ducts of the main beams through the ventilation spaces of the thin hollow columns, the second air guide holes, and the first air guide holes, and then sends the air to various places in the building.

10 Claims, 7 Drawing Sheets

(56) References Cited

U.S. PATENT DOCUMENTS

| | | | | |
|---|---|---|---|---|
| 2005/0138885 | A1* | 6/2005 | Rotherroe | E04C 3/32 52/843 |
| 2011/0036539 | A1* | 2/2011 | Balduini | F24S 50/80 165/47 |
| 2014/0374057 | A1* | 12/2014 | Lee | F28F 1/00 165/47 |
| 2016/0084513 | A1* | 3/2016 | Lee | A62C 35/68 454/328 |
| 2016/0152294 | A1* | 6/2016 | Kwag | B62M 6/90 180/220 |
| 2018/0127983 | A1* | 5/2018 | Roy | E04D 12/004 |
| 2018/0195306 | A1* | 7/2018 | Wiles | E04C 3/29 |
| 2019/0093347 | A1* | 3/2019 | Mizuno | E04B 2/825 |
| 2020/0048912 | A1* | 2/2020 | Roy | E04F 13/007 |
| 2020/0284042 | A1* | 9/2020 | Fithian | E04F 13/007 |
| 2021/0247077 | A1* | 8/2021 | Goldstein | E04F 13/007 |
| 2022/0034530 | A1* | 2/2022 | Fithian | F24F 7/06 |
| 2022/0341603 | A1* | 10/2022 | Goldstein | E04F 13/007 |

* cited by examiner

BUILDING FRAME STRUCTURE WITH BOTH SUPPORT AND VENTILATION FUNCTIONS

FIELD OF THE INVENTION

The present invention relates generally to beam-to-column system in a building structure, and more particularly, the present invention relates to a HVAC system prefabricated in a building structure so that the beam-to-column system have both support and ventilation functions, which effectively improves the traditional building process by optimizing the way of installation of HVAC system in the building to shorten the total building time.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In the housing industry, the process of building a home is tedious and time-consuming. Especially in the process of construction, it is necessary to consider how the HVAC system should be installed so that each room has an adequate source of air. And once the HVAC system is not installed properly, they need to be removed and re-installed, which creates additional cost and also waste much time. In addition, Traditionally, HVAC systems use independent pipelines to transport air, so it is necessary to reserve enough space in the traditional building for erecting these pipelines during construction, which will also make construction more inconvenient. If the time of installing the HVAC system and designing HVAC piping plans can reduce, then the building expenses and time will be greatly reduced.

Therefore, how to quickly and efficiently reduce the time for HVAC system constructions is the main problem that the applicant wants to solve.

SUMMARY

In order to solve the problem above, the present invention redefines the way of constructing HVAC system by combining the beam-to-column system with the HVAC system. Furthermore, the new beam-to-column system have unique structures to allow the worker to connect the ventilation spaces directly when installing the beams and columns to speed up the construction of the building.

It is therefore an object of the present invention to provide building frames, like beams and columns, that can be mass-produced in a factory by a manufacturer to have wire prefabricated on them.

It is another object of the present invention to provide a new way of processing building floors.

It is yet another object of the present invention to provide an improved traditional way of building houses, thereby increasing the efficiency of building houses.

To achieve the objects above, the present invention provides a building frame structure with both support and ventilation functions, the building frame structure contains at least one starting column and a plurality of main beams, the main beams are connected with the starting column, and top of the starting column is connected to a fan, comprising:

the starting column is a hollow cylinder, and a reinforcing structure is arranged inside the starting column, the reinforcing structure is connected with inner walls of the starting column to form a plurality of ventilation spaces, and surface of the starting column is provided with a plurality of air guide hole; and the main beams are hollow structures, and a reinforcing wall is arranged inside the main beams, the reinforcing wall is connected with inner walls of the main beam to form a plurality of ventilation ducts, and when the main beams and the starting column are connected to each other, the ventilation ducts correspond to the air guide holes so that the ventilation ducts and the air guide holes communicate with each other, and bottom of the main beams is provided with a plurality of ventilation holes;

wherein, air sent by the fan flows to the ventilation ducts of the main beams through the ventilation spaces and air guide holes of the starting column, and then sends the air to various places in the building through the ventilation holes.

In another aspect, wherein the reinforcing structure is a cross-shaped column structure.

In another aspect, wherein the starting column and the main beams are steel structure.

In another aspect, wherein one side of the main beams has an open end, and the other side is a closed end, and surface of the closed end is extended with a connecting structure for connection with other supporting columns.

In another aspect, wherein each of the ventilation holes is provided with an air shroud.

In some embodiments, the present invention further provides another building frame structure with both support and ventilation functions, the building frame structure contains at least one starting column and a plurality of main beams, the main beams are connected with the starting column, and top of the starting column is connected to a fan, comprising:

the starting column is a hollow cylinder, and there are four thin hollow columns in the starting column, surfaces of any thin hollow column are in close contact with other thin hollow columns and inner walls of the starting column respectively, and hollow portion of the thin hollow columns are ventilation spaces, and surface of the starting column is provided with a plurality of first air guide holes, and surfaces of the thin hollow columns are respectively provided with a second air guide hole corresponding to the first air guide holes; and the main beams are hollow structures, and a reinforcing wall is arranged inside the main beams, the reinforcing wall is connected with inner walls of the main beam to form a plurality of ventilation ducts, and when the main beams and the starting column are connected to each other, the ventilation ducts correspond to the first air guide holes and the second air guide holes, so that a communication state is formed between the ventilation ducts, the first air guide holes and the second air guide holes, and bottom of the main beams is provided with a plurality of ventilation holes;

wherein, air sent by the fan flows to the ventilation ducts of the main beams through the ventilation spaces of the thin hollow columns, the second air guide holes, and the first air guide holes, and then sends the air to various places in the building through the ventilation holes.

In another aspect, wherein thin hollow columns and the starting column are cuboid.

In this embodiment, the starting column and the main beams can also be steel structure.

In this embodiment, one side of the main beams also has an open end, and the other side is also a closed end, and surface of the closed end can also be extended with a connecting structure for connection with other supporting columns.

In this embodiment, each of the ventilation holes can also be provided with an air shroud.

In the present invention, the hollow beam and column are transformed to form a structure similar to a double I-shaped beam, which can bear the load and have the effect of ventilation at the same time. In the central part of the house is a column with ventilation spaces, which consists of four small hollow beams wrapped around a large hollow beam (in one embodiment). Since the central cross structure can bear weight, holes can be opened on the sides to allow air and wind to pass through. At the same time, the beam is transformed from a traditional I-shaped beam into a double hollow structure, which can guide the wind into the room while realizing the load-bearing function.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
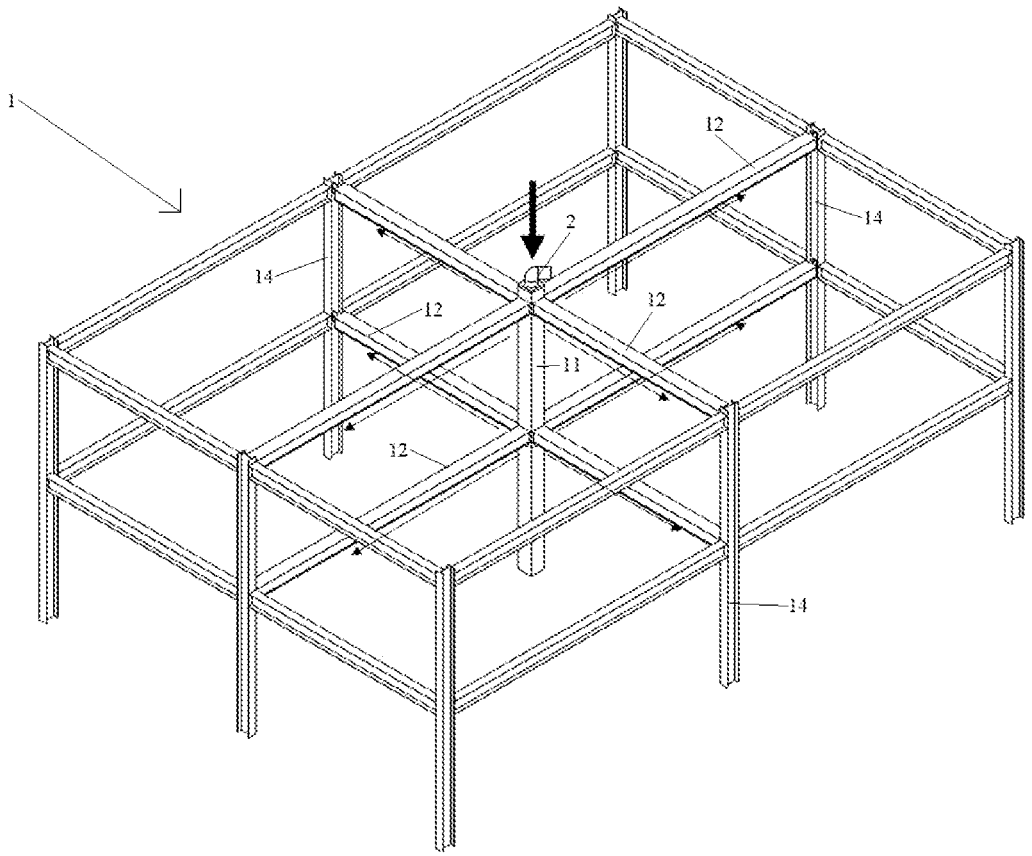
FIG. 1 illustrates the schematic view of a building frame structure with both support and ventilation functions.
Figure 2:
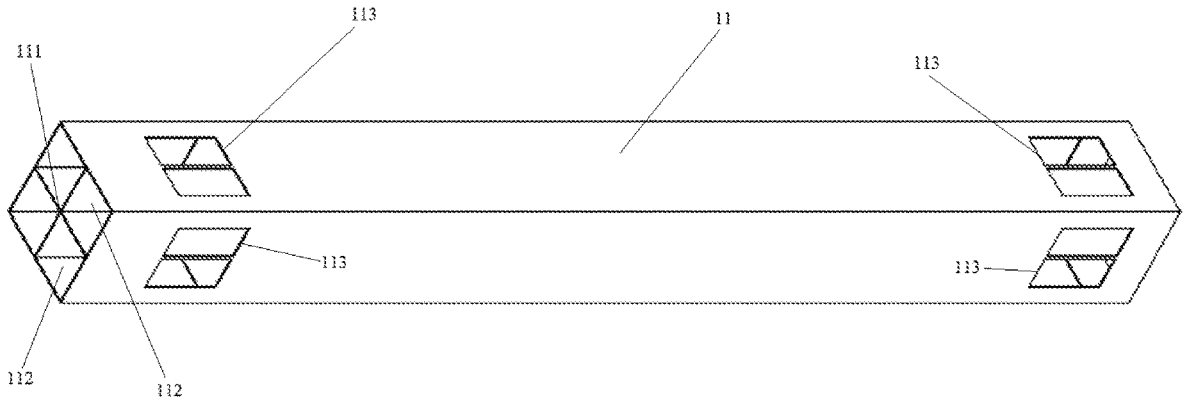
FIG. 2 illustrates the schematic view of the starting column in the first embodiment.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Please refer to FIGS. 1-2, and 4-8, they illustrate the schematic view of a first embodiment of a building frame structure with both support and ventilation functions and the detailed components that is needed to build the present invention. In the present invention, a building frame structure with both support and ventilation functions, the building frame structure contains at least one starting column 11 and a plurality of main beams 12, the main beams 12 are connected with the starting column 11, and top of the starting column 11 is connected to a fan 2. In detail, the starting column 11 is a hollow cylinder, and a reinforcing structure 111 is arranged inside the starting column 11, the reinforcing structure 111 is connected with inner walls of the starting column 11 to form a plurality of ventilation spaces 112, and surface of the starting column 11 is provided with a plurality of air guide hole 113. The main beams 12 are hollow structures, and a reinforcing wall 121 is arranged inside the main beams 12, the reinforcing wall 121 is connected with inner walls of the main beam 12 to form a plurality of ventilation ducts 122, and when the main beams 12 and the starting column 11 are connected to each other, the ventilation ducts 122 correspond to the air guide holes 113 so that the ventilation ducts 122 and the air guide holes 113 communicate with each other, and bottom of the main beams 12 is provided with a plurality of ventilation holes 123. When the frame structure 1 is installed, air sent by the fan 2 flows to the ventilation ducts 122 of the main beams 12 through the ventilation spaces 112 and air guide holes 113 of the starting column 11, and then sends the air to various places in the building through the ventilation holes 123.

Through such a structural design, the workers can complete the HVAC system of each floor together when constructing the beam-column system of the building, and the construction time can be greatly reduced since there is no need to install a separate and independent HVAC system. Moreover, the setting of the reinforcing structure 111 enables the starting column 11 to have sufficient support even if there are ventilation spaces 112, thereby achieving the effect claimed by the present invention. The main beams 12, through the transformation of the traditional I beam, have the functions of load-bearing and ventilation at the same time, and also correspond to the special structural setting of the starting column 11 provided by the present invention, so as to achieve a good match. Correspondence between the two can also shorten the time required for the construction process.

In detail, in this embodiment, the reinforcing structure 111 is a cross-shaped column structure. Since the cross-shaped reinforcing structure 111 can bear a considerable amount of weight in structure, the setting of the air guide holes 113 on the side will not affect the overall load-bearing capacity so that the present invention can still achieve the balance between the two functions of load-bearing and ventilation. Also, the starting column 11 and the main beams 12 are steel structures. Through the structure of the steel structure, the building frame 1 of the present invention can improve the supportability, and the structures for ventilation are not easily damaged, so as to improve the practicability of the present invention.

Figure 5:
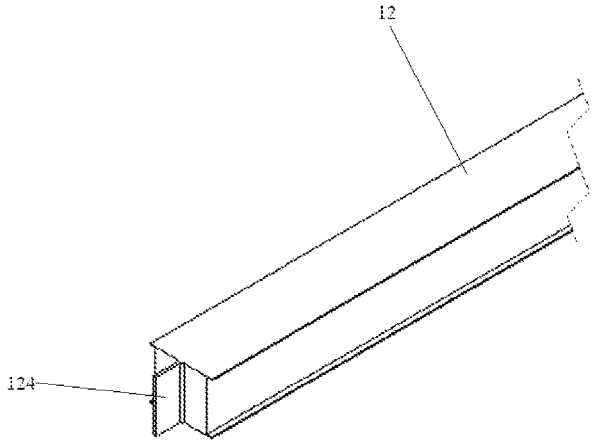
FIG. 5 illustrates the schematic view from another angle of the main beam.
Figure 6:
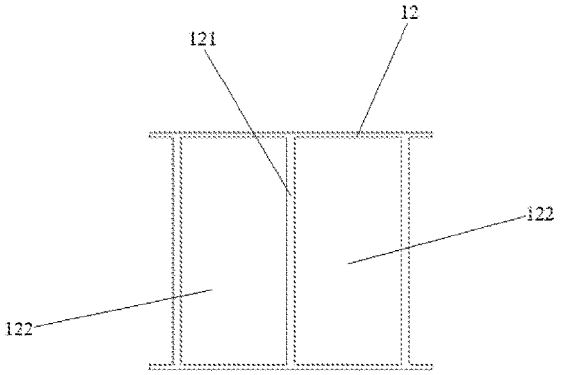
FIG. 6 illustrates the front plain view of the main beam.
Figure 7:
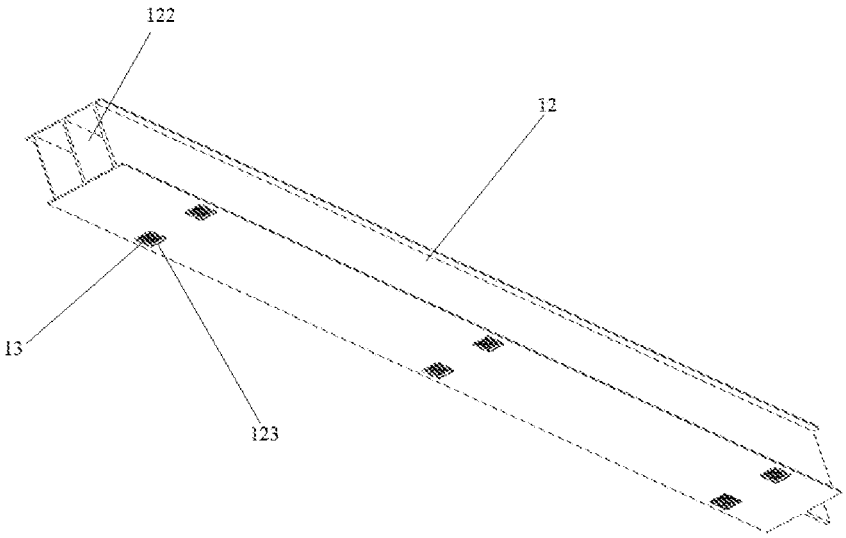
FIG. 7 illustrates the bottom view of the main beam.
Figure 8:
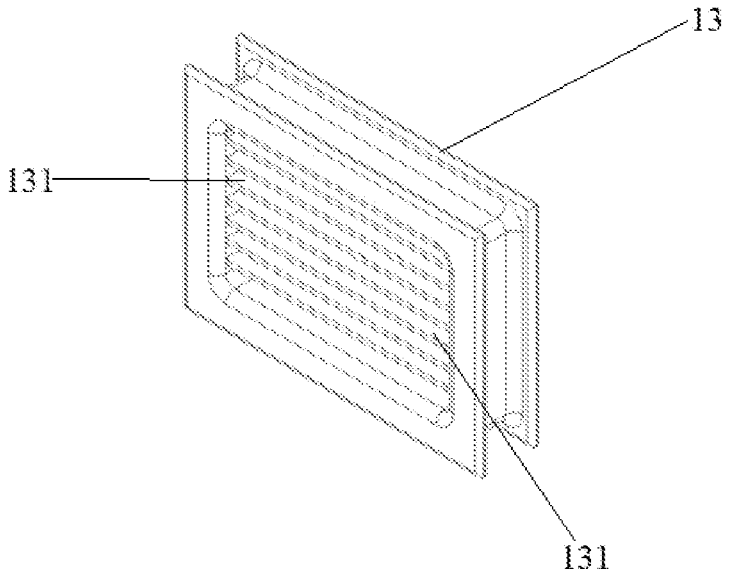
FIG. 8 illustrates the schematic view of the air shroud.

Furthermore, like shown in FIGS. 5 & 6, one side of the main beams 12 has an open end, and the other side is a closed end, and surface of the closed end is extended with a connecting structure 124 for connection with other supporting columns 14. This design allows all the air flowing to the main beams 12 to flow out from the ventilation holes 123 to all corners of the building so that the air in the building can be continuously circulated, and the main beams 12 not only have the function of transmitting air, but also can connect with other supporting columns 14 to form a complete frame structure 1, thereby ensuring the architectural stability of the present invention. In addition, each of the ventilation holes 123 is provided with an air shroud 13. It can be seen from FIG. 8 that the air shroud 13 has a plurality of guide plates 131, which can allow air to flow out from the ventilation holes 123 more efficiently, so as to improve the air circulation rate.

Figure 3:
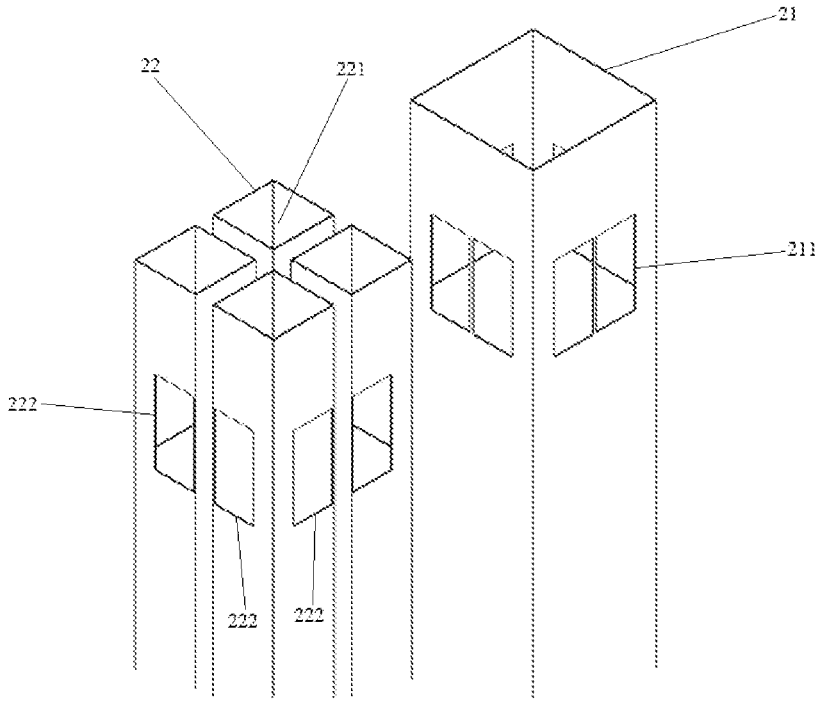
FIG. 3 illustrates the schematic view of the starting column in the second embodiment.
Figure 4:
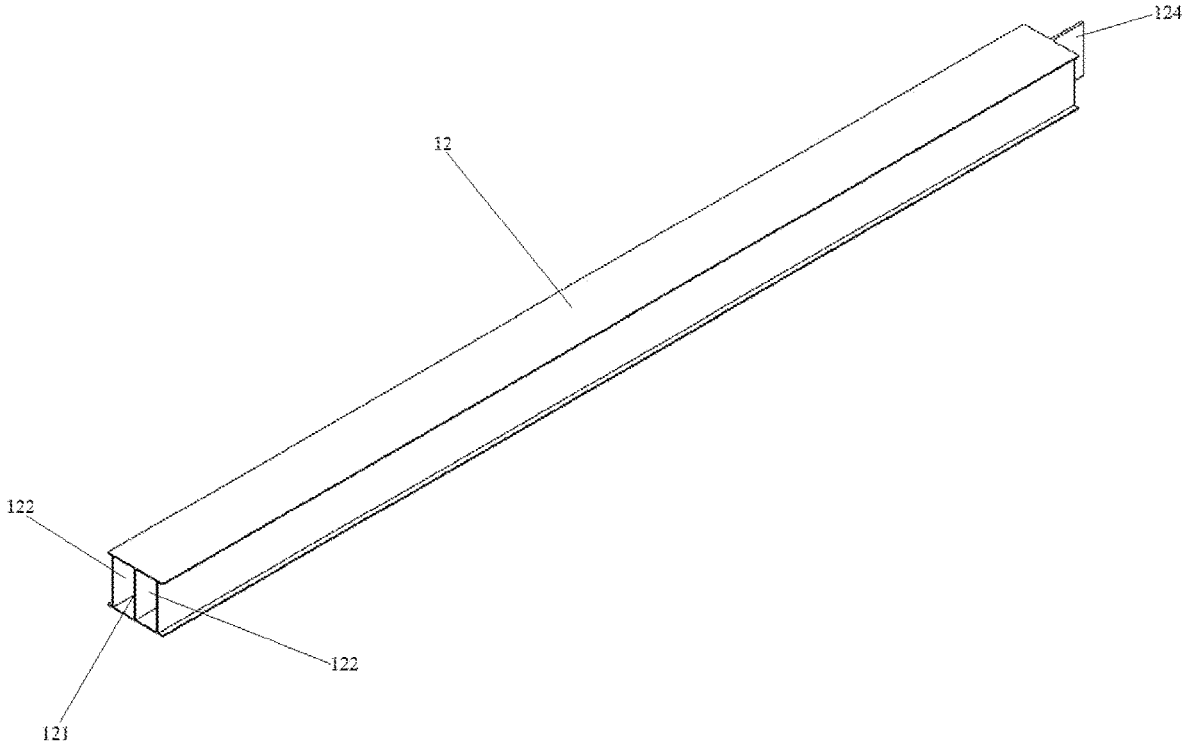
FIG. 4 illustrates the schematic view of the main beam.

Please refer to FIG. 3 with FIGS. 1 and 4-8, they illustrate the schematic view of a second embodiment of a building frame structure with both support and ventilation functions and the detailed components that is needed to build the present invention.

In this embodiment, a building frame structure with both support and ventilation functions, the building frame structure 1 contains at least one starting column 21 and a plurality of main beams 12, the main beams 12 are connected with the starting column 21, and top of the starting column 21 is connected to a fan 2. In detail, the starting column 21 is a hollow cylinder, and there are four thin hollow columns 22 in the starting column 21, surfaces of any thin hollow column 22 are in close contact with other thin hollow columns 22 and inner walls of the starting column 21 respectively, and hollow portion of the thin hollow columns 22 are ventilation spaces 221, and surface of the starting column 21 is provided with a plurality of first air guide holes 211, and surfaces of the thin hollow columns 22 are respectively provided with a second air guide hole 222 corresponding to the first air guide holes 211. The main beams 12 are hollow structures, and a reinforcing wall 121 is arranged inside the main beams 12, the reinforcing wall 121 is connected with inner walls of the main beam 12 to form a plurality of ventilation ducts 122, and when the main beams 12 and the starting column 21 are connected to each other, the ventilation ducts 122 correspond to the first air guide holes 211 and the second air guide holes 222, so that a communication state is formed between the ventilation ducts 122, the first air guide holes 211 and the second air guide holes 222, and bottom of the main beams 12 is provided with a plurality of ventilation holes 123. When the frame structure 1 is installed, air sent by the fan 2 flows to the ventilation ducts 122 of the main beams through the ventilation spaces 221, the second air guide holes 222, and the first air guide holes 211, and then sends the air to various places in the building through the ventilation holes 123.

In particular, the difference between the present embodiment and the previous embodiment lies in the difference in the supporting structures in the starting column. In this embodiment, the present invention wraps four thin hollow columns 22 in the starting column 21, so that the surfaces of the thin hollow columns 22 and the inner surface of the starting column 21 are tightly attached together, thereby enhancing the overall structural rigidity. In addition, the thin hollow columns 22 and the starting column 21 are cuboids, and such a design allows them to stick together more easily, which would also make the structure looks similar to the first embodiment, with a cross-shaped structure in the middle of the starting column 21. Since the cross-shaped structure is made by those thin hollow columns 22 sticks together, the strength of the joint portions will be higher compared to the first embodiment, and the supportability of the present invention is further improved. The rest of the elements are the same as those in the first embodiment, so the descriptions of those elements are not repeated in this embodiment.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A system for supporting and ventilating a building, comprising:

a building frame structure with both support and ventilation functions, the building frame structure contains at least one starting column and a plurality of main beams, the main beams are connected with the starting column, and top of the starting column is connected to a fan;

the starting column is a hollow cylinder, and a reinforcing structure is arranged inside the starting column, the reinforcing structure is connected with all inner walls of the starting column to define a plurality of ventilation spaces, and a peripheral surface of the starting column is provided with a plurality of air guide holes; and the main beams are hollow cuboid structures, and a reinforcing wall is arranged inside the main beams, the reinforcing wall is connected with all inner walls of the main beam to define a plurality of ventilation ducts, the ventilation ducts correspond to the air guide holes so that the ventilation ducts and the air guide holes communicate with each other, and bottom of the main beams is provided with a plurality of ventilation holes;

wherein, air sent by the fan flows to the ventilation ducts of the main beams through the ventilation spaces and air guide holes of the starting column, and then sends the air to predetermined places in the building through the ventilation holes.

2. The system of claim 1, wherein the reinforcing structure is a cross-shaped column structure.

3. The system of claim 2, wherein the starting column and the main beams are steel structure.

4. The system of claim 3, wherein one side of the main beams has an open end, and other side is a closed end, and top surface of the closed end is extended with a connecting structure for connection with other supporting columns.

5. The system of claim 4, wherein each of the ventilation holes is provided with an air shroud.

6. A system for supporting and ventilating a building, comprising:

a building frame structure with both support and ventilation functions, the building frame structure contains at least one starting column and a plurality of main beams, the main beams are connected with the starting column, and top of the starting column is connected to a fan;

the starting column is a hollow cylinder, and there are four thin-walled hollow columns nested in the starting column, peripheral surfaces of the hollow columns are in close contact with each other and all inner walls of the starting column respectively, and hollow portions of each of the hollow columns are ventilation spaces, and a peripheral surface of the starting column is provided with a plurality of first air guide holes, and the peripheral surfaces of the hollow columns are each respectively provided with a second air guide hole corresponding to the first air guide holes; and the main beams are hollow structures, and a reinforcing wall is arranged inside the main beams, the reinforcing wall is connected with all inner walls of the main beam to define a plurality of ventilation ducts, the ventilation ducts correspond to the first air guide holes and the second air guide holes, so that a communication state is formed between the ventilation ducts, the first air guide holes and the second air guide holes, and bottom of the main beams is provided with a plurality of ventilation holes;

wherein, air sent by the fan flows to the ventilation ducts of the main beams through the ventilation spaces, the second air guide holes, and the first air guide holes, and then sends the air to predetermined places in the building through the ventilation holes.

7. The system of claim 6, wherein the hollow columns and the starting column are cuboid.

8. The system of claim 7, wherein the starting column and the main beams are steel structure.

9. The system of claim 8, wherein one side of the main beams has an open end, and other side is a closed end, and top surface of the closed end is extended with a connecting structure for connection with other supporting columns.

10. The system of claim 9, wherein each of the ventilation holes is provided with an air shroud.

* * * * *